US012092121B2

(12) United States Patent
Gallina et al.

(10) Patent No.: US 12,092,121 B2
(45) Date of Patent: Sep. 17, 2024

(54) BLADE SYSTEM FOR FANS FOR INDUSTRIAL USE

(71) Applicant: Cofimco S.r.l., Pombia (IT)

(72) Inventors: Carlo Gallina, Marano Ticino (IT); Emanuele Torno, Cuggiono (IT); Alberto Manassa, Vespolate (IT)

(73) Assignee: Cofimco S.r.l., Pombia (IT)

( * ) Notice: Subject to any disclaimer, the term of this patent is extended or adjusted under 35 U.S.C. 154(b) by 0 days.

(21) Appl. No.: 17/909,873

(22) PCT Filed: Mar. 4, 2021

(86) PCT No.: PCT/IB2021/051826
§ 371 (c)(1),
(2) Date: Sep. 7, 2022

(87) PCT Pub. No.: WO2021/181225
PCT Pub. Date: Sep. 16, 2021

(65) Prior Publication Data

US 2023/0094150 A1 Mar. 30, 2023

(30) Foreign Application Priority Data

Mar. 10, 2020 (IT) ..... 102020000005110

(51) Int. Cl.
*F04D 29/08* (2006.01)
*F04D 25/08* (2006.01)
(Continued)

(52) U.S. Cl.
CPC ..... *F04D 25/08* (2013.01); *F04D 25/088* (2013.01); *F04D 29/34* (2013.01); *F04D 29/384* (2013.01); *F04D 29/388* (2013.01)

(58) Field of Classification Search
CPC ..... F04D 29/34; F04D 29/388; F04D 29/384; F04D 25/088; F03D 1/0675; F03D 1/0683; F03D 1/0658; F03D 1/065
See application file for complete search history.

(56) References Cited

U.S. PATENT DOCUMENTS 7,252,478 B2 * 8/2007 Aynsley ..... F03B 17/063 416/204 R
7,284,960 B2 * 10/2007 Aynsley ..... F04D 29/34 416/223 R
(Continued)

FOREIGN PATENT DOCUMENTS

EP 2397783 A1 12/2011

OTHER PUBLICATIONS

International Search Report and Written Opinion for PCT/IB2021/051826 Dated Jun. 7, 2021.

*Primary Examiner* — Brian P Wolcott
*Assistant Examiner* — Behnoush Haghighian
(74) *Attorney, Agent, or Firm* — Cook Alex Ltd.

(57) ABSTRACT

Described herein is a blade system (10) for fans for industrial use, comprising: —a blade (12), which extends longitudinally along a first reference axis (K) and defines within it a cavity (12A), wherein said blade has a cross section with flattened profile and is oriented with a major dimension (L1) along a second reference axis (H); and—a supporting unit (14), on which said blade (12) is fixed and which is inserted within the cavity (12A) of said blade, said supporting unit (14) being designed to be connected to the rotor (2) of a fan. The system is characterized in that: said cavity (12A) of said blade (12) has a cylindrical conformation and a cross section with flattened profile and is oriented with its major dimension (L2) along said second reference axis (H); and said supporting unit (14) comprises a tubular bar (16), which has a cross section with flattened profile and is oriented with a
(Continued)

major dimension (L3) along said second reference axis (H), or else a first tubular bar (26A) and a second tubular bar (26C) with circular cross section, which are arranged alongside one another along said second reference axis (H).

26 Claims, 6 Drawing Sheets

(51) Int. Cl.
*F04D 29/34* (2006.01)
*F04D 29/38* (2006.01)

(56) References Cited

U.S. PATENT DOCUMENTS 7,934,907 B2 * 5/2011 Aynsley ..... F04D 29/388 416/210 A
8,079,823 B2 * 12/2011 Aynsley ..... F04D 29/384 416/243
8,177,514 B2 * 5/2012 Hibbard ..... F03D 1/0683 416/226
8,579,588 B1 * 11/2013 Boyd ..... F04D 29/646 416/204 R
9,261,074 B2 * 2/2016 Jacobsen ..... F03D 1/0658
9,388,789 B2 * 7/2016 Hibbard ..... F03D 1/0675
9,541,097 B1 * 1/2017 Boyd ..... F04D 25/088
9,726,192 B2 * 8/2017 Whitley ..... F04D 29/325
9,797,369 B2 * 10/2017 Kratmann ..... F03D 1/0633
9,874,214 B2 * 1/2018 Whitley ..... F04D 25/088
10,544,790 B2 * 1/2020 Horng ..... F04D 29/388
2008/0014090 A1 * 1/2008 Aynsley ..... F04D 29/34 416/204 R
2011/0158788 A1 * 6/2011 Bech ..... F03D 1/0683 29/889.7
2012/0269643 A1 * 10/2012 Hibbard ..... F03D 1/0675 29/889
2014/0140850 A1 * 5/2014 Jacobsen ..... F03D 1/0658 416/204 R
2015/0110632 A1 * 4/2015 Rohden ..... F03D 9/25 29/889.7
2015/0211532 A1 * 7/2015 Whitley ..... F04D 29/34 29/889.3
2015/0292477 A1 * 10/2015 Kratmann ..... F03D 1/0675 416/232

* cited by examiner

BLADE SYSTEM FOR FANS FOR INDUSTRIAL USE

CLAIM OF PRIORITY

This application is the U.S. National Stage of PCT International Patent Application No. PCT/IB2021/051826, filed Mar. 4, 2021, which claims priority to and the benefit of Italian Application No. 102020000005110, filed Mar. 10, 2020, the contents of both of which are hereby incorporated by reference in their entirety.

The present invention relates to a blade system for fans for industrial use of the type comprising:

- a blade, which extends longitudinally along a first reference axis and defines within it a cavity, wherein the blade has a cross section with flattened profile and is oriented with a major dimension along a second reference axis; and
- a supporting unit, fixed to which is said blade and which is inserted into the cavity of the blade, the supporting unit being designed to be connected to the rotor of a fan.

A blade system of the type referred to is commonly used in fans for industrial use of large diameter (usually being defined as such fans having a diameter of from 5 m up to 20 m).

In operation, the blades of such fans are subject to very high cyclic and impulsive loads, which subject the supporting units that connect the blades to the rotor of the fan to considerable stress.

For this reason, the supporting unit and, in particular, the characteristics of strength thereof represent the main reference for defining the cycle of service life of a blade system.

The supporting unit itself has an effect also on the performance of the blade during operation, considering that deformations and vibrations of the supporting unit can modify the action of the blade on the fluid conveyed.

According to a known conventional solution, the supporting unit comprises a tubular bar with circular cross section. The circular cross section is very widely used because it is suitable for withstanding the torsional stresses transmitted by the blade and moreover renders possible adjustment of the inclination of the blade with respect to its own longitudinal axis when the blade is connected to the rotor of the fan.

To improve the strength of this type of supporting unit, use of materials with good mechanical characteristics has been proposed that are able to increase the resistance of the bar in regard, above all, to bending stresses.

Moreover, in the document No. EP3218608 A1, filed in the name of the present applicant, use of an additional bar, mounted within a tubular bar, has also been proposed so that this additional bar will intervene as damping member in regard to phenomena of oscillation of the blade during operation.

Once again with reference to the known solution referred to, for applications in which the loads acting on the blade are particularly intense it is also possible to use a bar of oversized diameter. This also involves, however, an increase in the size of the blade used. In particular, a different blade is selected that is accordingly oversized, so that the selected bar with oversized diameter can be inserted within the blade and it will be possible to connect them together. All this results in an oversizing aerodynamic performance of the system and in higher costs.

In this context, the object of the present invention is to provide a blade system that will be further improved, in particular from the standpoint of strength and operating performance.

The object referred to is achieved by a blade system according to claim 1.

As will be seen in what follows, the system described herein makes it possible to overcome the drawback referred to above, which requires a change in size of the blade in order to increase the strength of the supporting unit.

The claims form an integral part of the technical teaching provided herein in relation to the invention.

The invention will now be described, purely by way of non-limiting example, with reference to the annexed representations, wherein.

Illustrated in the ensuing description are various specific details aimed at enabling an in-depth understanding of the embodiments. The embodiments may be provided without one or more of the specific details, or with other methods, components, or materials, etc. In other cases, known structures, materials, or operations are not illustrated or described in detail so that various aspects of the embodiment will not be obscured.

The references used herein are provided only for convenience and hence do not define the sphere of protection or the scope of the embodiments.

Figure 1:
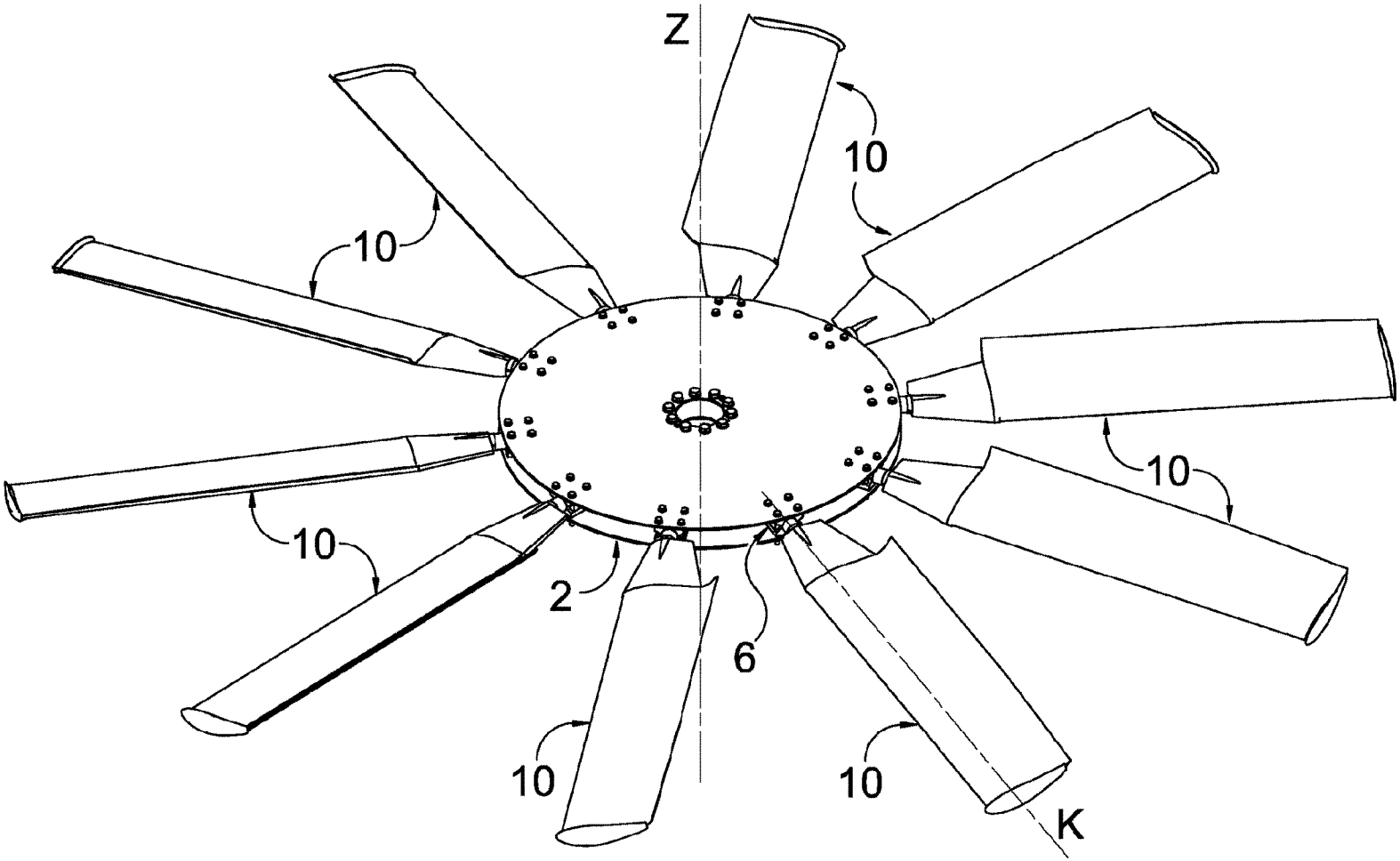
FIG. 1 represents, according to an axonometric view, a fan for industrial use provided with a blade system of the type described herein.
Figure 2:
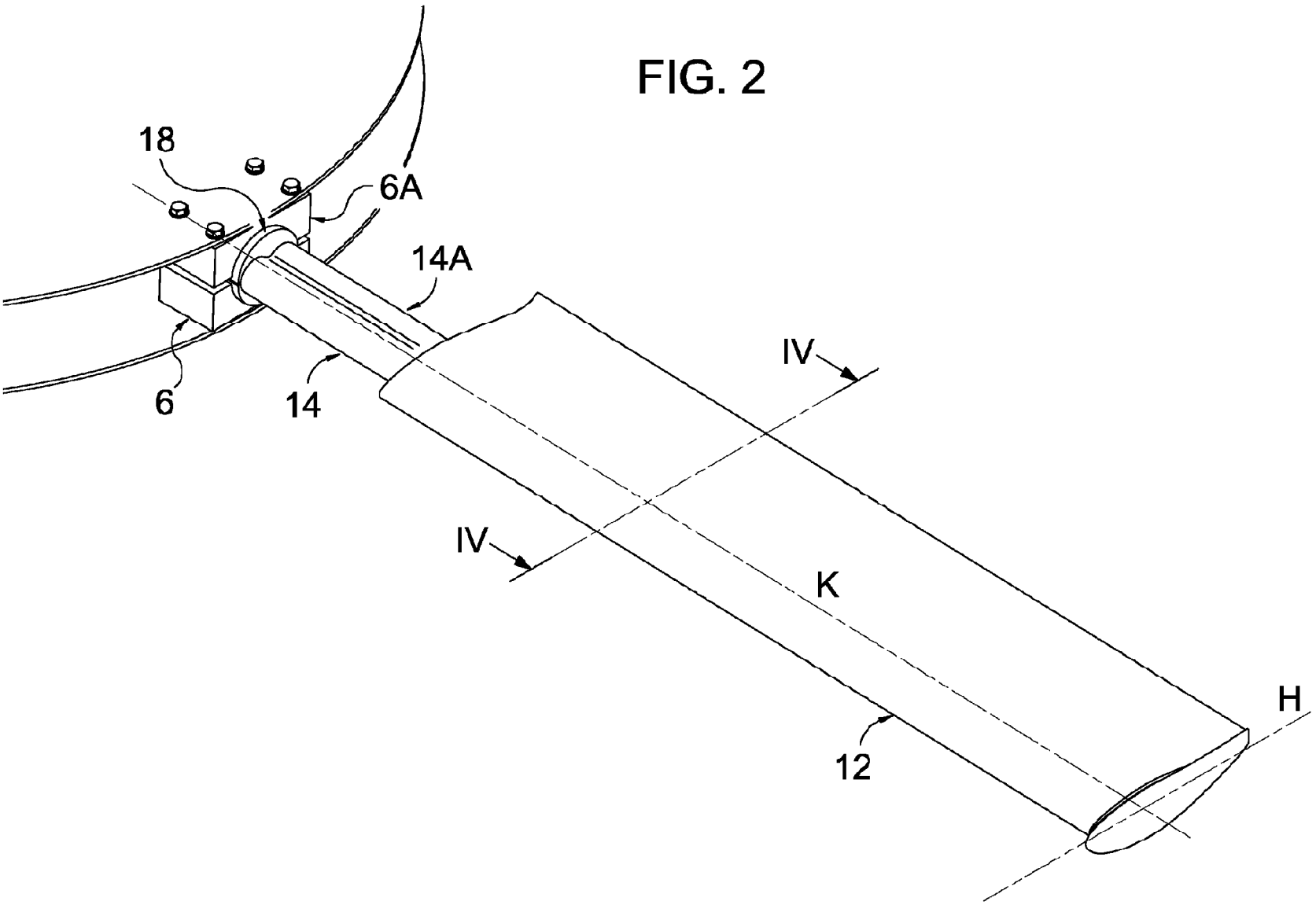
FIG. 2 represents a blade system of the type described herein according to a preferred embodiment.
Figure 3:
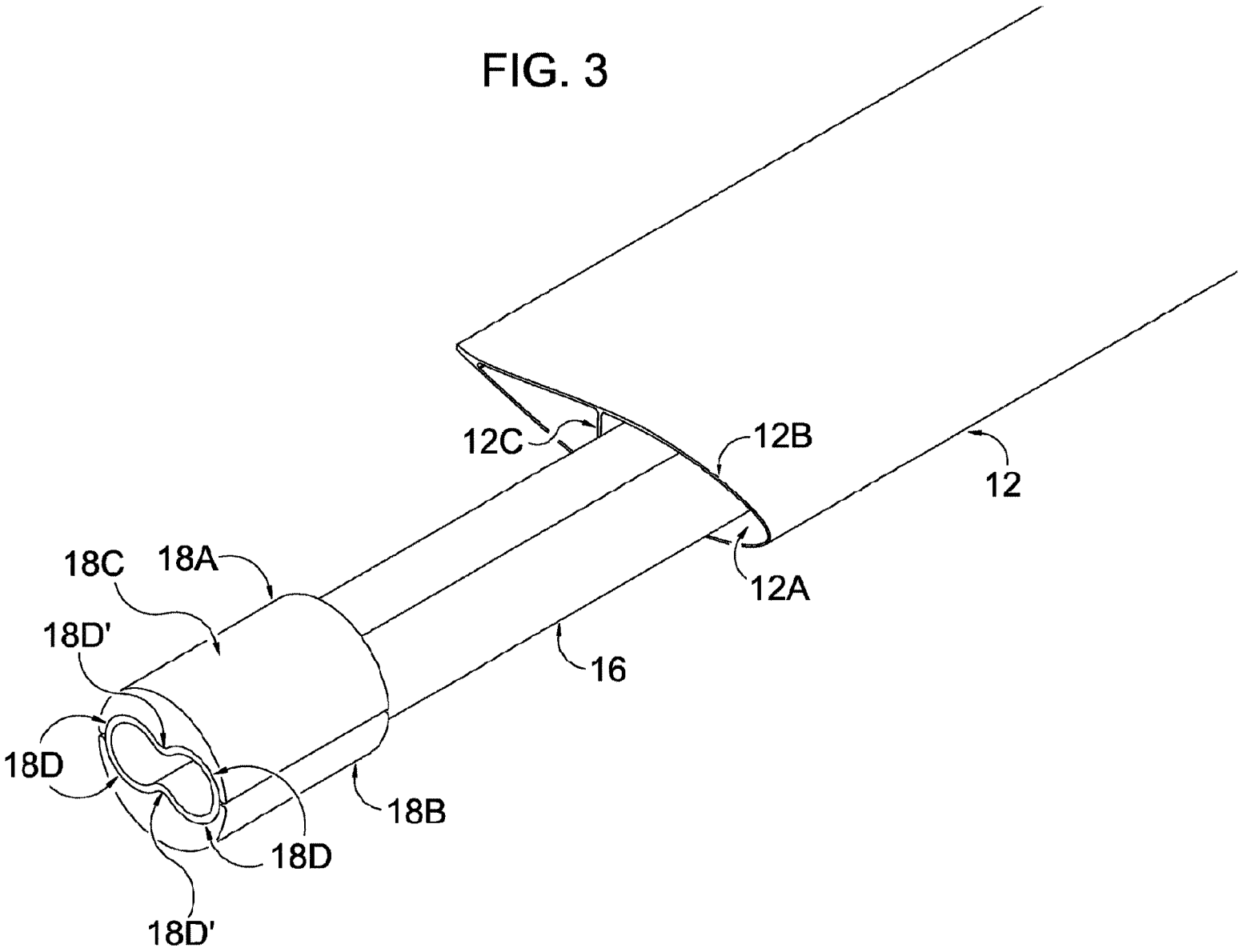
FIG. 3 represents a detail of the blade system of FIG. 2, according to an axonometric view.

With reference to FIG. 1, this illustrates an industrial fan 1 comprising a rotor 2 rotatably mounted about a vertical axis Z, and a plurality of blades 10, which are arranged about the rotor 2 and fixed to the latter via connection devices 6.

According to the solution described herein, each blade 10 is constituted by a blade system comprising:

- a blade 12, which extends longitudinally along a reference axis K; and
- a supporting unit 14 to which the blade 12 is fixed and which is designed to be connected to the rotor 2, in the way illustrated in FIG. 1, via a connection device 6.

Figure 4:
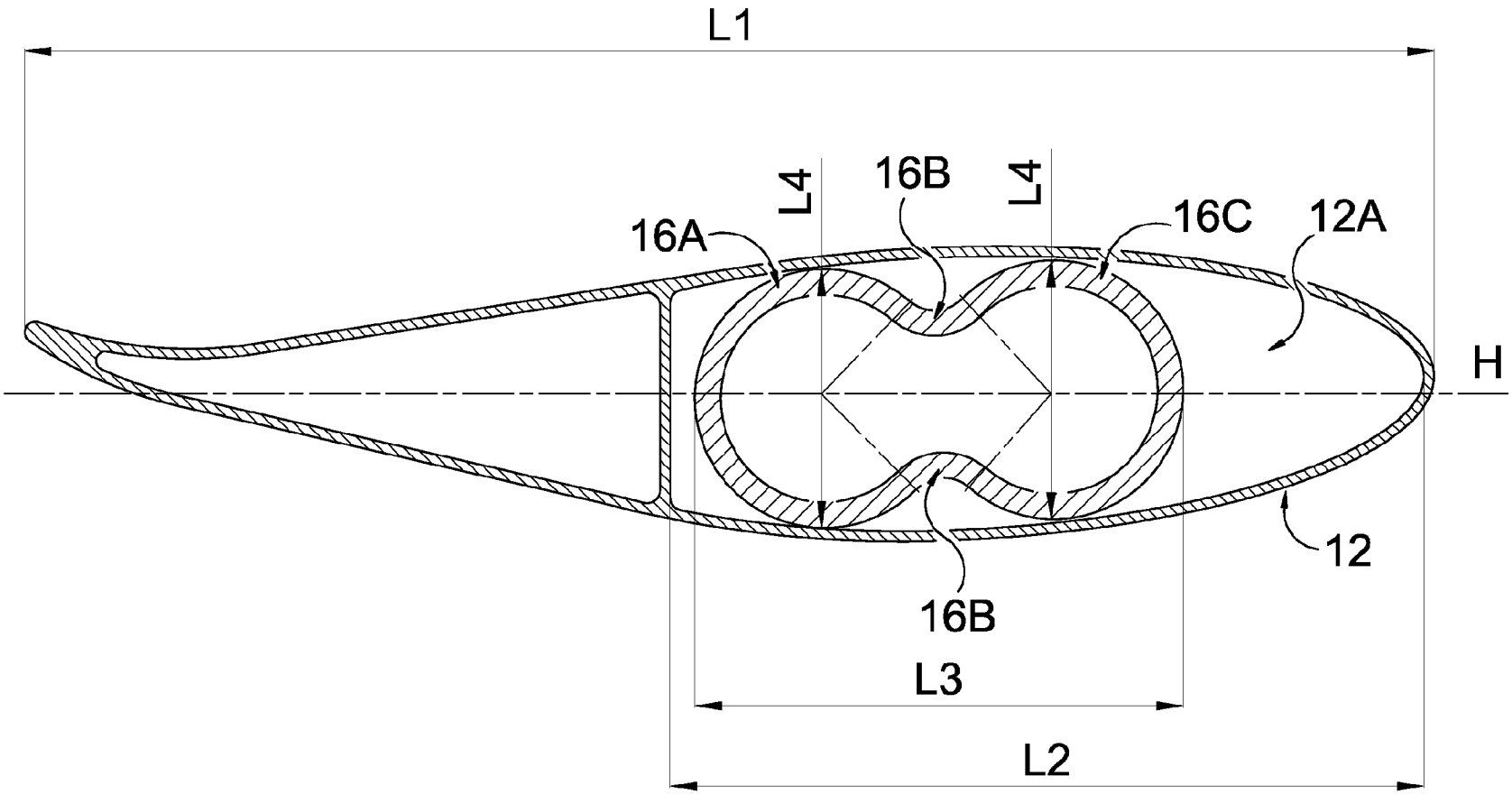
FIG. 4 represents a cross-sectional view of the blade system of FIG. 2, according to the plane of section IV-IV of the same figure.

The blade 12 has a cross section with flattened profile and is oriented with a major dimension L1 (aerodynamic chord) set in a direction parallel to a reference axis H (FIG. 4). The profile of the blade 12 is a conventional aerodynamic profile determined as a function of the performance required by the specific applications.

To return to FIG. 1, in the condition where the blade 12 is installed on the rotor 2, the blade 12 itself has its reference axis K oriented radially with respect to the axis of rotation Z and the reference axis H oriented in a direction transverse to both of the two axes Z and K.

The blade 12 has a cavity 12A inside it, inserted in which is the supporting unit 14 to provide mutual connection of the two components.

For instance, the above connection may be obtained via screws (not illustrated), which are inserted, from outside, into the blade 12 and come to engage the supporting unit 14 housed within the cavity 12A of the blade. In any case, other modes of connection are likewise possible, for example via gluing.

The supporting unit 14 projects from the blade 12 with an end portion 14A of its own that is designed for connection to the rotor 2 of the fan.

According to an important characteristic of the blade system described herein, the cavity 12A of the blade 12 extends along the axis K having a cylindrical conformation with a cross section having a flattened profile oriented so as to set a major dimension L2 along the reference axis H.

Moreover, the supporting unit 14 comprises a tubular bar 16, having, in a similar way, a cross section with flattened profile and oriented so as to set a major dimension L3 along the same reference axis H.

Preferably, the two sections, namely, that of the internal cavity 12A and that of the tubular bar 16, have shapes and dimensions such as to enable provision of a mutual shape fit between the blade 12 and the bar 16. Alternatively, it is possible to envisage one or more adapter elements prearranged for being set between the walls of the internal cavity 12A and the tubular bar 16.

The aforesaid configuration provides a supporting structure of the blade that makes it possible to bestow on the blade system a greater strength, without thereby having to increase the external dimensions of the blade 12.

Given the same external dimensions of the blade, the system described herein hence presents a greater strength as compared to the known solutions mentioned at the start. In particular, the present applicant has been able to verify that the system described herein is characterized by a considerably higher bending strength and a considerably higher natural frequency of the blade; this latter aspect is fundamental for moving the fan away from typical conditions of resonance to which the blades may be subject.

In preferred embodiments, as in the one illustrated, the tubular bar 16 has a cross section with a profile that comprises two substantially circular portions 16A, 16C joined together by two opposed intermediate portions 16B, 16B'.

Preferably, the two circular portions 16A, 16C each reproduce an arc of a circle defined by an angle greater than 180°, even more preferably greater than 270°.

In preferred embodiments, as in the one illustrated, the two portions 16A, 16C are of the same size, or in any case the corresponding resistant areas (meaning thereby the areas of the annuli defined by the two portions) present a difference between them of less than 15%.

In alternative embodiments, the tubular bar 16 may present a flattened profile of some other type, for example rectangular, elliptical, trapezial, rhomboidal, etc.

On the other hand, the cavity 12A may present a cross section that reproduces the external profile of the blade 12, as in the example illustrated.

In preferred embodiments, as in the one illustrated, the cavity 12A is delimited by the outer wall 12B, which identifies the external profile of the blade, and by an inner wall 12C, which performs a function of reinforcement of the structure of the blade 12.

Preferably, the cross section of the tubular bar 16 identifies a dimension L4, in a direction transverse to the reference axis H, which is substantially equal to the dimension identified, in the same direction and in the corresponding region, by the cavity 12A, so as to provide a shape fit between the cavity 12A and the tubular bar 16. In the example illustrated, such a correspondence is present for each of the two circular portions 16A, 16C. The shape fit referred to may or may not be of a forced type.

To return to FIG. 1, the blade system described herein further comprises a positioning member 18, which is prearranged for connecting the supporting unit 14 to the rotor 2, providing the possibility of varying the orientation or inclination of the blade 12 about the reference axis K.

In preferred embodiments, as in the one illustrated, the member 18 comprises two opposed shaped elements 18A, 18B, which are prearranged for gripping between them the tubular bar 16, at its end portion, and for defining, as a whole, an outer cylindrical surface 18C. Preferably, the two elements 18A, 18B moreover define an internal passage 18D, traversed by the bar 16, which is delimited by walls 18D' that follow, at least partially, the profile of the bar itself.

The positioning member 18 is designed to be received within a seat 6A, having a corresponding shape and size, which is made in the connection device 6. The coupling of a rotary type thus obtained between the connection device 6 and the positioning member 18 makes it possible to vary the orientation or inclination of the blade 12 about the reference axis K. Blocking members (not illustrated) block the blade 12 in position after it has been set in the pre-set orientation or inclination.

Figure 5:
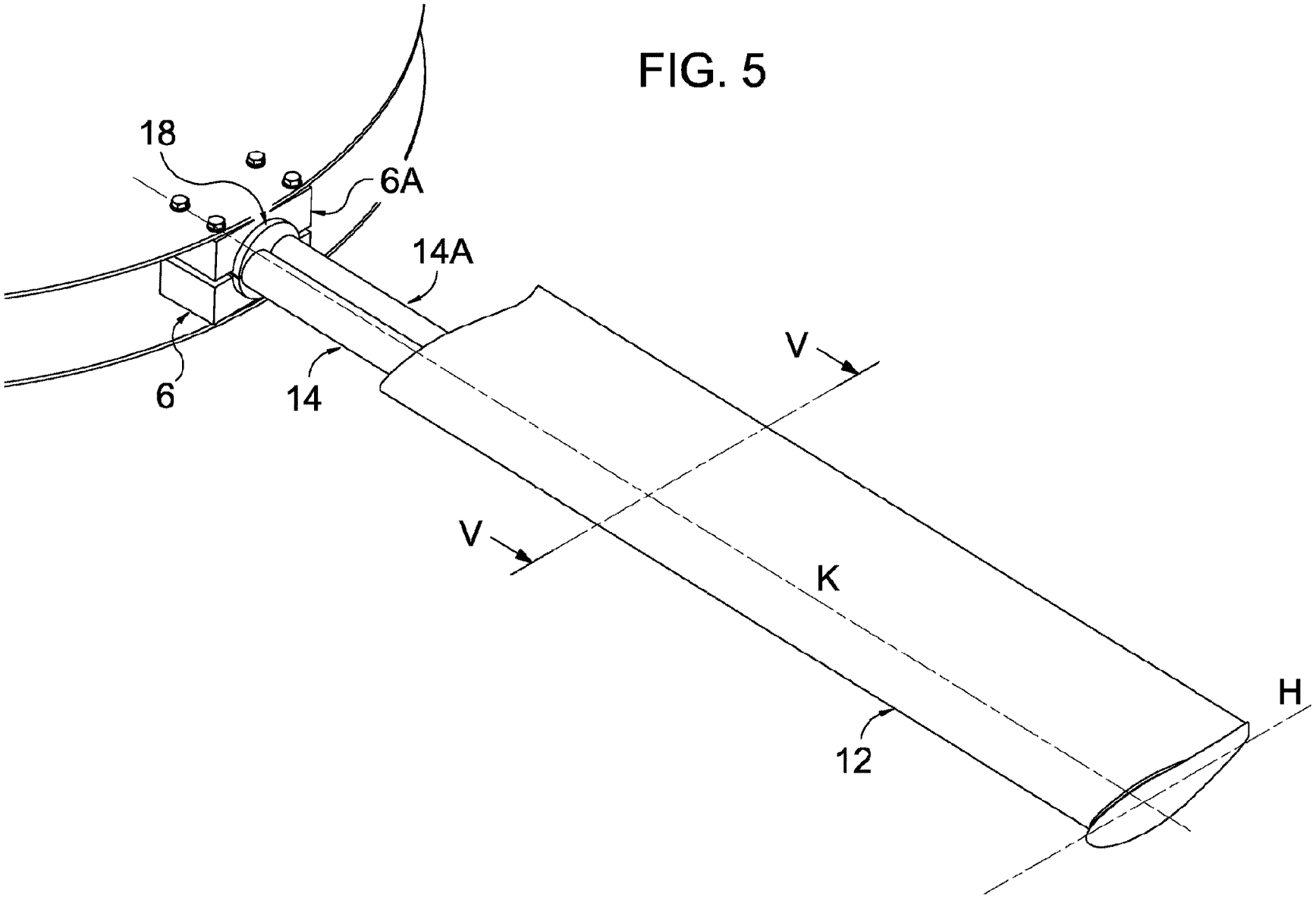
FIG. 5 represents an alternative embodiment of the blade system described herein.
Figure 6:
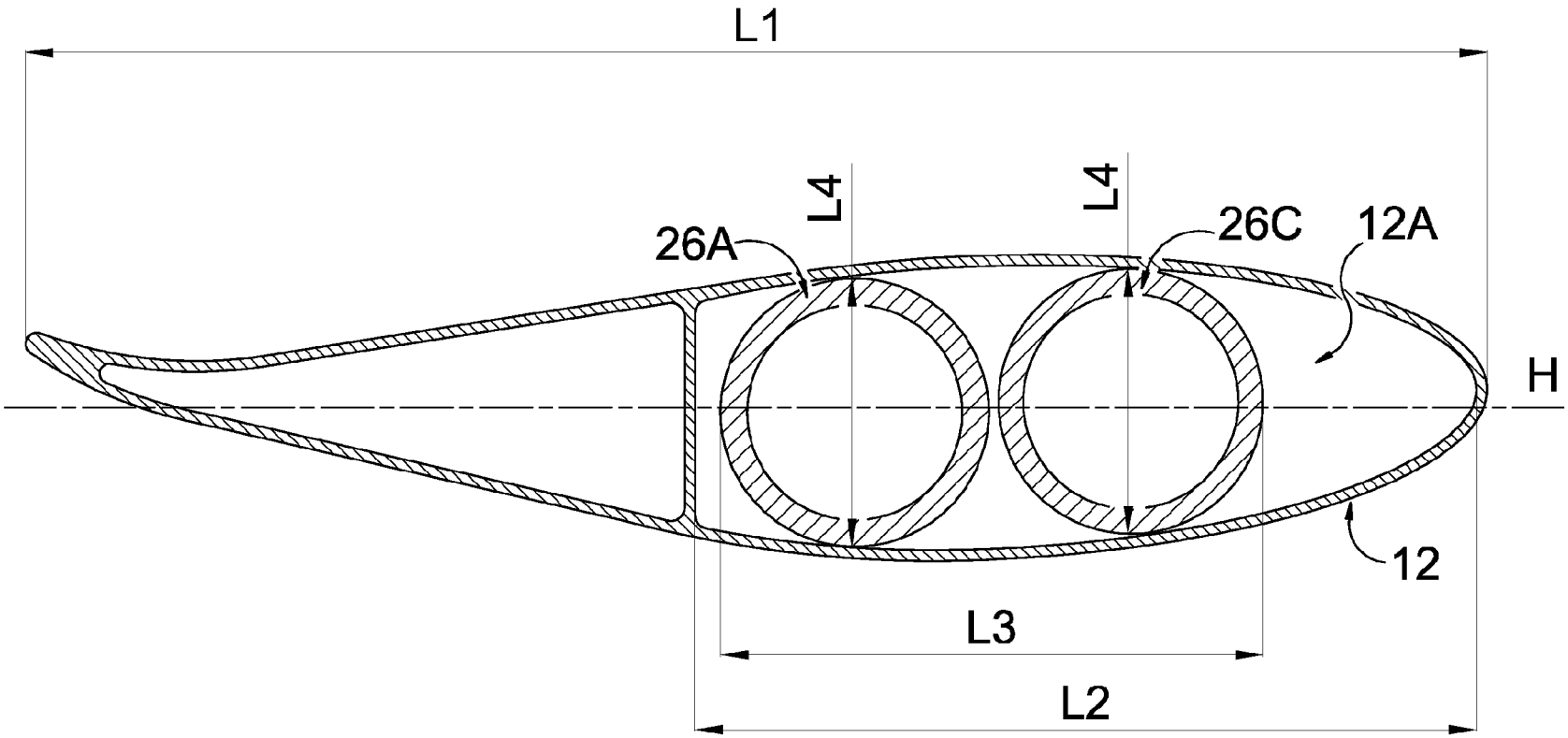
FIG. 6 illustrates a cross-sectional view of the blade system of FIG. 5, according to the plane of section V-V of the same figure.

With reference now to FIGS. 5 and 6, these represent an alternative embodiment in which the supporting unit 14 provides, instead of the tubular bar 16, two distinct tubular bars 26A, 26C, which are received within the cavity 12A according to an arrangement in which they are set alongside one another along the reference axis H. The two bars 26A, 26C each have a circular cross section.

Preferably, the two bars 26A, 26C are arranged in contact with one another, or in any case at a negligible distance apart with respect to their longitudinal dimension.

The person skilled in the branch will understand that the two bars 26A, 26C substantially perform the same structural function as the two circular portions 16A, 16C of the tubular bar 16 of the previous embodiment.

Preferably, the two bars 26A, 26C are joined together via purposely provided connection members, for example belts, tapes, brackets, etc.

On the other hand, the teachings and considerations already expressed above also apply to this embodiment. In particular, it will be noted that the positioning member 18 may be prearranged for receiving the two bars 26A, 26C together.

Advantageously, the blade system described herein may also envisage one or more additional bars to be set inside the tubular bar 16 or inside the two bars 26A, 26C, according to the teachings of the document No. EP3218608 A1 mentioned above.

Of course, without prejudice to the principle of the invention, the details of construction and the embodiments may vary, even significantly, with respect to what has been illustrated herein purely by way of non-limiting example, without thereby departing from the scope of the invention, as defined by the annexed claims.

The invention claimed is:

1. A blade system for fans for industrial use, comprising:

a blade, which extends longitudinally along a first reference axis and defines within it a cavity, wherein said blade has a cross section with a flattened profile and is oriented with a major dimension along a second reference axis;

a supporting unit, on which said blade is fixed and which is inserted within the cavity of said blade, said cavity of said blade having a cylindrical conformation and a cross section with flattened profile and is oriented with the major dimension along said second reference axis;

said supporting unit comprising a tubular bar, which has a cross section with a flattened profile and is oriented with the major dimension along said second reference axis, or a first tubular bar and a second tubular bar with circular cross sections, which are arranged alongside one another along said second reference axis;

a positioning member located at an end of said supporting unit, wherein said positioning member is configured to connect the supporting unit and blade to a rotor of a fan;

a connection device including a seat configured to receive the positioning member; and wherein said positioning member is rotatable about the first reference axis such that the orientation of the blade can vary when said positioning member is coupled to said seat.

2. The system according to claim 1, wherein the cross section of said tubular bar has a profile comprising two circular portions joined together by two opposed intermediate portions.

3. The system according to claim 2, wherein said two circular portions each reproduce an arc of a circle defined by an angle greater than 180°.

4. The system according to claim 3, wherein said two circular portions have the same size or a difference between their areas of less than 15%.

5. The system according to claim 1, wherein said first and second tubular bars have the same size or a difference between their areas of less than 15%.

6. The system according to claim 1, wherein the cross section of said tubular bar has a flattened profile selected from one of the following: rectangular, elliptical, trapezial, and rhomboidal.

7. The system according to claim 1, wherein said first and second bars are arranged in contact with one another, or at a distance apart that is negligible with respect to their longitudinal dimension.

8. The system according to claim 1, wherein said first and second bars are joined together via connection members.

9. The system according to claim 1, comprising at least one adapter, which is prearranged for receiving said tubular bar or said first and second tubular bars, and for setting itself within said cavity between the walls of said cavity and said tubular bar or said first and second tubular bars.

10. The system according to claim 1, wherein the positioning member is coupled to the seat with a rotary-type coupling, providing the possibility of varying the orientation of the blade about said first reference axis.

11. The system according to claim 10, wherein said positioning member comprises two opposed shaped elements, which are prearranged for gripping between them said tubular bar or said first and second bars and define, as a whole, an outer cylindrical surface.

12. The system according to claim 11, wherein said two opposed elements are prearranged for defining an internal passage, which is traversed by said bar, or by said first and second bars, and is delimited by walls that follow the external profile of said bar or of said first and second bars.

13. The system according to claim 2, wherein said two circular portions have the same size or a difference between their areas of less than 15%.

14. The system according to claim 6, wherein said first and second bars are arranged in contact with one another, or at a distance apart that is negligible with respect to their longitudinal dimension.

15. The system according to claim 5, wherein said first and second bars are joined together via connection members.

16. The system according to claim 6, wherein said first and second bars are joined together via connection members.

17. The system according to claim 7, wherein said first and second bars are joined together via connection members.

18. The system according to claim 8, comprising at least one adapter, which is prearranged for receiving said tubular bar or said first and second tubular bars, and for setting itself within said cavity between the walls of said cavity and said tubular bar or said first and second tubular bars.

19. The system according to claim 9, wherein said positioning member is coupled to the seat with a rotary-type coupling, providing the possibility of varying the orientation of the blade about said first reference axis.

20. The system according to claim 19, wherein said positioning member comprises two opposed shaped elements, which are prearranged for gripping between them said tubular bar or said first and second bars and define, as a whole, an outer cylindrical surface.

21. The system according to claim 1, wherein the seat includes a shape and size corresponding to said positioning member.

22. The system according to claim 1, wherein said connection device is coupled to the rotor of a fan.

23. The system according to claim 11, wherein said seat includes a cylindrical shape corresponding to the outer cylindrical surface of the positioning member.

24. The system according to claim 23, wherein said connection device includes a first piece and a second piece, wherein the first piece and the second piece define the seat when the first piece and the second piece are connected to one another.

25. The system according to claim 20, wherein said seat includes a cylindrical shape corresponding to the outer cylindrical surface of the positioning member.

26. The system according to claim 25, wherein said connection device includes a first piece and a second piece, wherein the first piece and the second piece define the seat when the first piece and the second piece are connected to one another.

* * * * *